US005373598A

United States Patent [19]

Weber et al.

[11] Patent Number: 5,373,598

[45] Date of Patent: Dec. 20, 1994

[54] CLEANER WITH PERFORMANCE INDICATOR

[75] Inventors: Vincent L. Weber, North Lawrence; Charles R. Morrow, Alliance; Edgar A. Maurer, Canton; William J. Chess, Sr., North Canton, all of Ohio

[73] Assignee: The Hoover Company, North Canton, Ohio

[21] Appl. No.: 75,795

[22] Filed: Jun. 14, 1993

[51] Int. Cl.[5] ..... A47L 9/00

[52] U.S. Cl. ..... 15/339; 116/284

[58] Field of Search ..... 15/339; 116/200, 284, 116/285

[56] References Cited

U.S. PATENT DOCUMENTS

| | | | |
|---|---|---|---|
| 1,324,416 | 12/1919 | Stewart . | |
| 1,907,692 | 5/1933 | White | 15/339 |
| 2,720,186 | 10/1955 | Springer | 116/285 |
| 3,253,295 | 5/1966 | Waters | 15/339 |
| 3,266,078 | 8/1966 | Brown et al. | 15/319 |
| 4,163,999 | 8/1979 | Eaton et al. | 361/23 |
| 4,392,271 | 7/1983 | Sepke | 15/339 |
| 4,728,942 | 3/1988 | England | 15/339 |
| 4,731,898 | 3/1988 | Sovis | 15/339 |
| 4,955,103 | 9/1990 | Scott | 15/339 |
| 5,056,175 | 10/1991 | Stein | 15/339 |

FOREIGN PATENT DOCUMENTS

| | | |
|---|---|---|
| 3204272A | 8/1983 | Germany . |
| 2081074A | 2/1982 | United Kingdom . |
| 2167655A | 6/1986 | United Kingdom . |

*Primary Examiner*—Stephen F. Gerrity
*Assistant Examiner*—Terrence R. Till

[57] ABSTRACT

A vacuum cleaner having a belt driven rotating agitator is provided with an indicia containing rotating dial, directly driven by one of these moving translating or rotating parts, to thereby indicate a problem or performance goal existent in one of them.

20 Claims, 4 Drawing Sheets

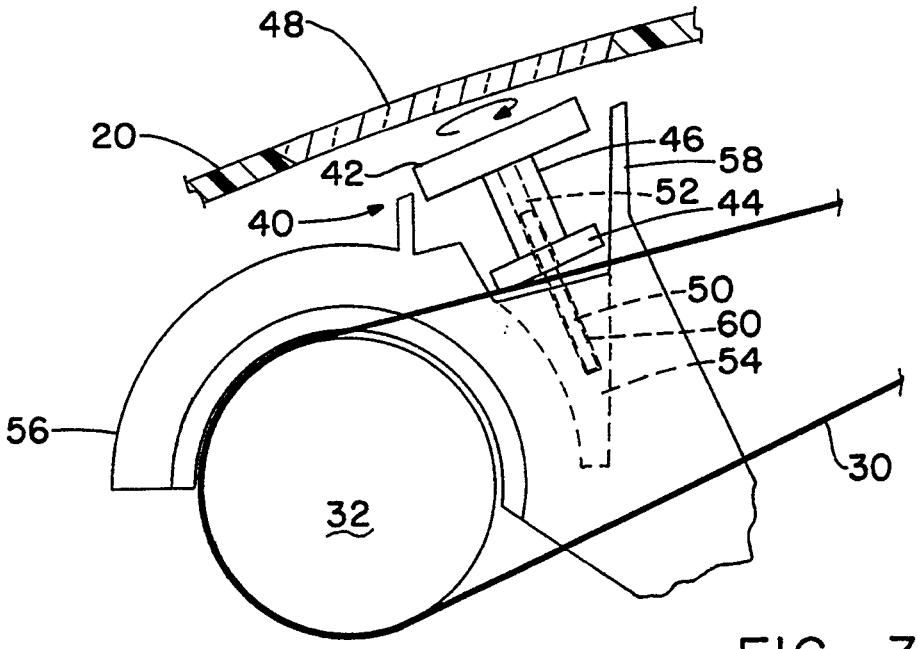
FIG.-3
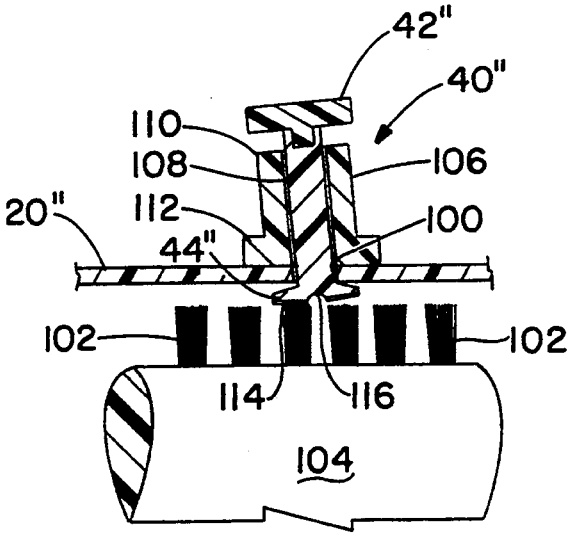
FIG.-7
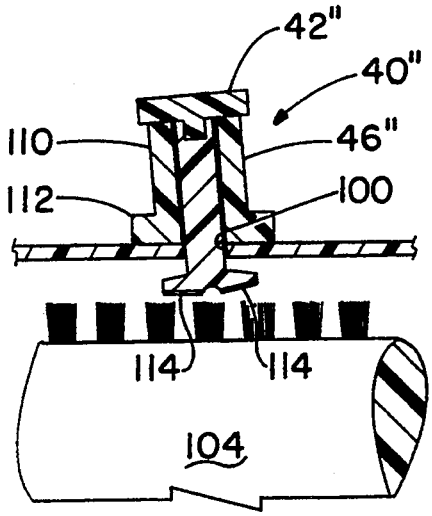
FIG.-8
FIG.-9
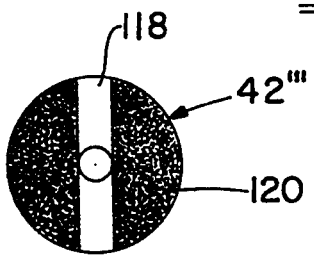

CLEANER WITH PERFORMANCE INDICATOR

BACKGROUND OF THE INVENTION

1. Field of the Invention

The present invention relates to vacuum cleaners and, more specifically, to an indicator, directly driven by one of the moving or rotating parts of the cleaner.

2. Description of Prior Art

Vacuum cleaners with belt driven agitators are known in which some means of indication is provided to indicate, e.g., belt breakage or a stalled belt condition. These indicators include agitator mounted magnets which physically drive a separate magnet containing indicator disk to denote rotation or to electrically indicate to a magnetic pulse receiving network to indicate this same rotation. These indicators also include ones that, essentially, react with or against the belt. One of these structures used a cogged belt to insure arrest of it at the motor shaft under stall conditions, with the motor being fused and thereby becoming inoperative under this condition to indicate cleaner non-performance. Several other structures react against the belt. They depend on the displacement of the belt from its normal tracking at stall to move a linkage or abutment to thereby turn off an electric switch in a motor circuit. How much better and simpler to directly drive an indicating disk by the moving part of the vacuum cleaner being monitored.

Accordingly, it is an object of this invention to directly drive an indicating disk by a moving member of a vacuum cleaner.

It is a further object of the invention to provide a vacuum cleaner indicator by the use of a directly driven indicator disk.

It is an additional object of the invention to provide a disk driven by a vacuum cleaner agitator belt which acts as a stalled or broken belt indicator.

It is a still further object of the invention to provide a disk driven by the agitator to proven a worn brush indicator.

It is an even further object of the invention to provide an indicator with indicia thereon and to abuttingly, drivingly engage this indicator with a moving member of a vacuum cleaner to thereby directly indicate that the moving member is, in fact, moving.

It is an additional object of the invention to provide an improved indicator structure in a vacuum cleaner.

SUMMARY OF THE INVENTION

A vacuum cleaner having a belt driven agitator is provided with a rotatable indicator which is driven by the moving belt or agitator. The indicator is journalled for rotation with the nozzle and may be disposed below its top surface with a window in the nozzle or may extend through the nozzle top surface permitting operation visibility for easy viewing. The indicator includes a disk having indicia such as a white bar disposed across its top diametrically, with the disk being formed of black material for contrast. The indicator includes a driving wheel disk disposed spacedly below the indicator disk and connected to it by a stub shaft with these three elements, ideally, all being made of plastic.

The indicator driving disk wheel physically engages the agitator driving belt in the broken or stalled belt indicator arrangement. This driving disk wheel is disposed off center relative to the belt to impart unbalanced rotating torsion to it and is also angled in relation to it to only receive a vector of its velocity and to encourage some slippage so that the speed at its periphery is less than the peripheral speed of the belt. It thereby rotates more slowly than the belt and requires a less complex and less expensive bearing arrangement. To this end, an axially extending steel bearing pin is loosely inserted into a central blind bore opening at the driving wheel side of the indicator so as to extend outwardly therefrom for journalling the belt indicator during its rotational movement. The lower end of this pin is conveniently fixedly attached to an internal partition or strap contained in the nozzle.

The indicator utilized to signify a worn brush condition has its disk drive wheel disposed so as to contact the uppermost brush tufts' strip of a brush mounted on the agitator. It extends loosely but pilotingly through the top nozzle surface so that as brush wear occurs, it may slowly move downwardly to yet be still contacted by the now partially worn brushes. A hollow cylindrical bearing is mounted on a top nozzle surface so as to surround a rotating intermediate stem of the indicator. Upon full brush wear, its top surface is engaged by a bottom surface of the disk preventing further downward movement of the indicator and at least partially disengaging it from being drivingly rotated by the agitator brushes. The driving wheel of this indicator is offset relative to its engaging brush tuft so as to be torque-rotated by it. The driving wheel is also angled relative to the brush tufts' strip to reduce its rotational velocity relative to the rotational velocity of the agitator.

BRIEF DESCRIPTION OF THE DRAWINGS

Reference may now be had to the accompanying Drawings for a better understanding of the invention, both as to its organization and function, with the illustration showing several embodiments, but being only exemplary, and in which:

FIG. 3 is a partial, enlarged cross-sectional of the power assisted cleaner of FIG. 1 and showing the indicator and belt disposition;

FIG. 7 is a fragmentary front cross-sectional view of an agitator and agitator housing with the agitator brushes unworn and utilizing a worn brush indicator;

FIG. 8 is a similar view with the brushes worn; and

FIG. 9 is a top plan view of an indicator disk utilizable in this invention.

DETAILED DESCRIPTION OF THE INVENTION

Figure 1:
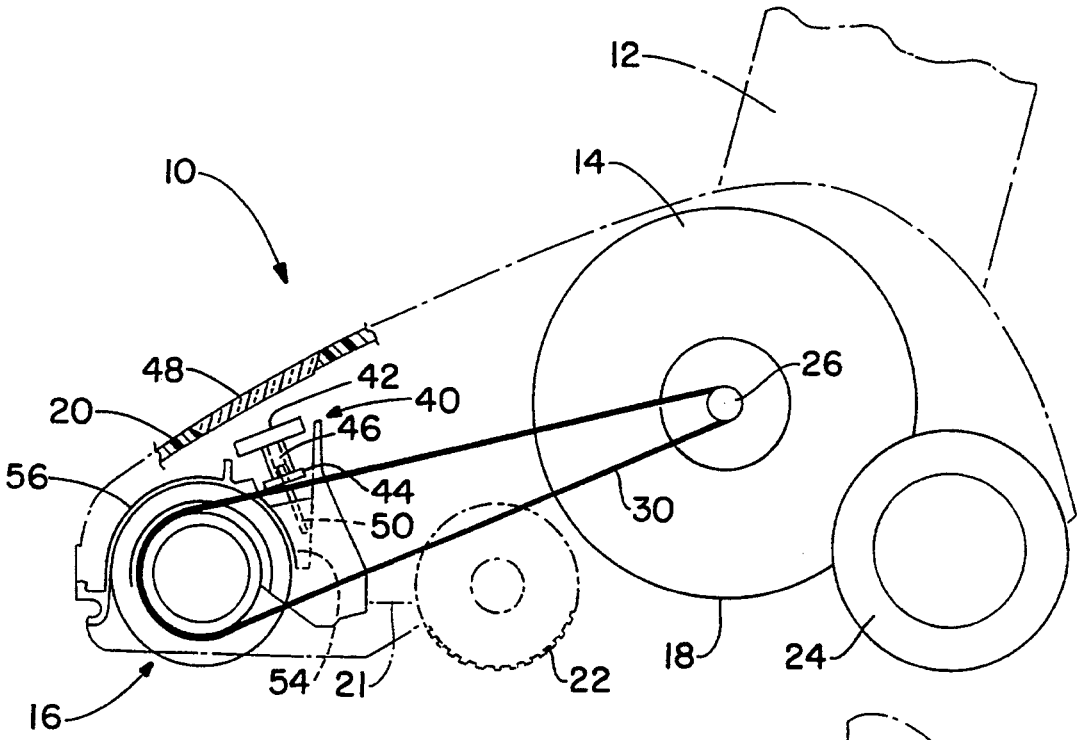
FIG. 1 is a cross-sectional, partly fragmentary, side elevational view of a power assisted cleaner incorporating the inventive belt indicator.
Figure 2:
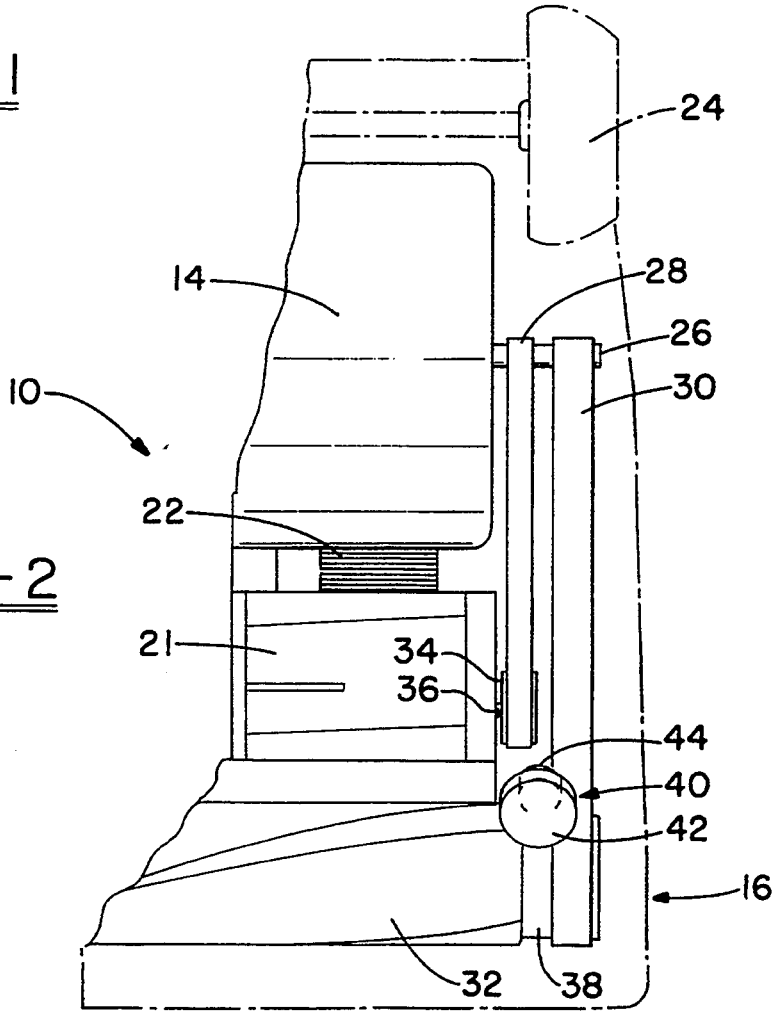
FIG. 2 is, a generally, a slightly less than half plan view of this same cleaner with the suction nozzle housing removed.
Figure 4:
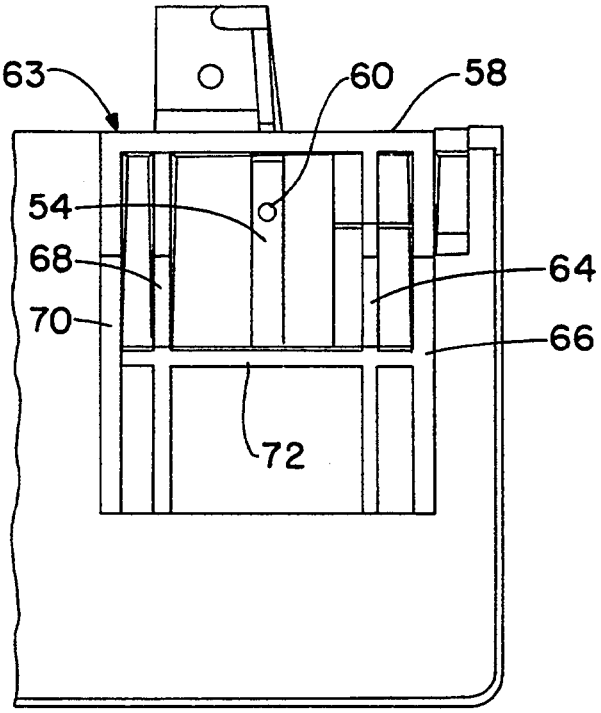
FIG. 4 is a partial plan view of the right corner of the agitator housing of FIG. 2.

There is partially shown in FIGS. 1–4, a power assisted cleaner 10 which has provision for a broken or stalled belt indicator. This belt indicator and its incorporation in this cleaner is the preferred form of the invention.

Power assisted cleaner 10 includes a hard bag 12 extending upwardly to terminate in a handle (not shown) and carries at its bottom a motor 14. As is conventional, the hard bag 12 is pivoted to a nozzle 16 by a lower housing portion 18 of it. A hood 20 covers the working elements of the power drive cleaner 10 including a transmission 21 which drives a pair of forward drive wheels 22, 22 (only one shown) which along with rear trundle wheels 24, 24 (only one shown) permit the power assisted cleaner 10 to translate over a surface being cleaned.

The motor 14 includes a rotating pulley shaft 26 which drivingly carries a pair of drive belts 28, 30, with the belt 28 extending forwardly to the intermediately disposed transmission 21 and the belt 30 extending forwardly to an agitator 32 situated at the front of the nozzle 16. The belt 28 rotationally drives transmission pulley 34 attached to a drive shaft 36 of the transmission 20 while the belt 30 drives the agitator 32 through a pulley drive section 38 of it.

An indicator 40 comprising an indicator disk 42, spacedly disposed upwardly from a drive wheel disk 44 by a spacing shaft 46 is located within the nozzle hood 20. The indicator 40 is situated directly below a transparent slanted window 48 by being rotationally mounted on an upstanding fixed metallic shaft 50. The indicator 40 includes a bore 52 which loosely and rotationally accommodates the shaft 50. The indicator 40 may be made integrally of a single piece of plastic and, ideally, of a black color (see later).

The shaft 50 is mounted fixedly within nozzle 16 below hood 20 in a somewhat triangular shaped piece 54 having its major apex downwardly disposed. This piece is connected, at its forward side, to a housing 56 containing the agitator 32 and at its rearward side to a small, back section 58 of this same housing. The shaft 50 is held in its mounted position by being force fit in a blind bore 60 in triangularly shaped piece 54, with the bore 60 being angled upwardly forwardly relative to the horizontal so that indicator 40 is at this same angle (23° ahead of vertical was chosen for this nozzle), relative to the horizontal, and, more importantly, so that it angled in this same manner relative to the agitator belt 30.

The indicator 40, essentially, sits on the belt 30 while mounted on the shaft 50 by bore 52. This bore extends upwardly to the indicator disk 42 so that only belt 30 limits its downward movement. At this position, the drive wheel disk 44 lightly engages the agitator belt 30 so that the indicator 40 is drivingly rotated by it. In the event of belt breakage the drive wheel disk 44 drops to rest on the triangular shaped piece 54.

To insure this rotation, the drive wheel disk 44 and the indicator 40 are disposed off center (their center) relative to the belt 30 so that an unbalanced driving torque is imposed on driving wheel disk 44 by the belt 30 to drivingly rotate indicator 40. Also, since the indicator 40 is disposed angularly relative to the direction of reach and movement of belt 30, only a vector of its velocity is effective in the forced rotation of the indicator 40 Additionally, more slippage occurs between the belt 30 and indicator 40 than if a flat engaging drive was utilized. This reduces the indicator's speed markedly and permits the use of an inexpensive bearing, as above described, yet one of sufficient durability for this application. It should also be pointed out that, in nozzle 16, that this angular disposition of the indicator 40 results in an inclination of the indicator disk 42 similarly to the inclination of the window 48 and surrounding portions of the hood 20.

The triangularly shaped piece 54 is disposed to extend axially fore and aft along the nozzle 16, medially within a reinforcing box-like matrix 63 comprising inwardly and outwardly rightward and leftward walls 64, 66, 68 and 70, respectively. These walls attach at their rearward ends to back section 58 and intermediate their forward ends to a small front reinforcing section wall 72 of agitator housing 56. This wall is shorter that the back section 58, due to the curve of the back side of the agitator housing 56 which also dictates that the walls 64, 66, 68 and 70 are somewhat triangular in elevation like the shaft mounting triangularly shaped piece 54 to provide a smooth merging with agitator housing 56. These walls may, ideally, all be integral with the agitator housing 56 and are angled on their top edges to form a flat, angled plane for the mounting of the slanted lens or window 48 in the hood 20 by gluing, snap fit or the like. The window attachment arrangement forms no part of this invention.

In a second embodiment of the invention, a vacuum cleaner 10' includes a nozzle 16' with conventional wheels (not shown) and having a hood 20' that extends over and covers the operative elements in the nozzle. These include: an agitator 32' at the nozzle front; a motor 14' disposed near the rear of the nozzle; and an agitator driving belt 30' extending therebetween. A rotating motor shaft 26' mounts one end of the belt 30' while its other end is received over an agitator pulley section 38'.

An indicator 40', utilized to indicate belt stall or breakage, is disposed in an upper portion 74 of hood 20' beneath a window or lens 48' and extends downwardly therefrom to engage belt 30' and to be driven by it. The indicator 40' includes, as in the first preferred embodiment, a drive wheel disk 44', an indicator disk 42' and a spacing shaft 46' extending therebetween. The drive wheel disk 44' and spacing shaft 46' may be integrally molded but the indicating disk 42' takes the form of a plug which is force fit in a blind bore 76 formed in the upper end of the spacing shaft 46'. Its bottom, then, is in abutting relationship with the top surface of the spacing shaft 46'.

The indicator 40' is rotationally mounted within the nozzle 16' by a bent shaft 50' having a straight bearing section 78 which loosely and rotationally extends into a bore 52' in indicator 40'. A downwardly bent section 80 of shaft 50' integrally attached to the bearing shaft section 78 and, further, extends to a generally horizontal partial coil section 82. The shaft 50' is completed by a straight end portion 84.

The shaft 50' is mounted in nozzle 16 by use of a mounting block 86 having a rectangular prismatic shape, in side elevation, at its bottom portion, which integrally joins to a right triangular prismatic shape, in side elevation, at its top. This block also includes a front side having a flat, but angled side 88 (see FIG. 6). These sides closely abut a vertically extending rib 92, integral with the hood 20', and a bottom angled surface portion 94 of this same hood. The block 86 may be attached to the hood 20' by gluing or by being molded integrally therewith.

The bent shaft 50' is captivatingly mounted at its front end on a bottom side 90 of block 86. The block 86 on this bottom side has a threaded bore over which the partial coil section 80 of bent shaft 50' is disposed over and within which a screw 96 is inserted. A washer 98 is positioned between the bottom side of the head of the screw and the partial coil section 80 to tightly hold bent shaft 50' to the block 86 when the screw 96 is tightened. The bent shaft 50' may also be additionally anchored by the straight end portion 84 of the bent shaft engaging in a surface notch (not shown) in the bottom side 90 of block 86.

Figure 6:
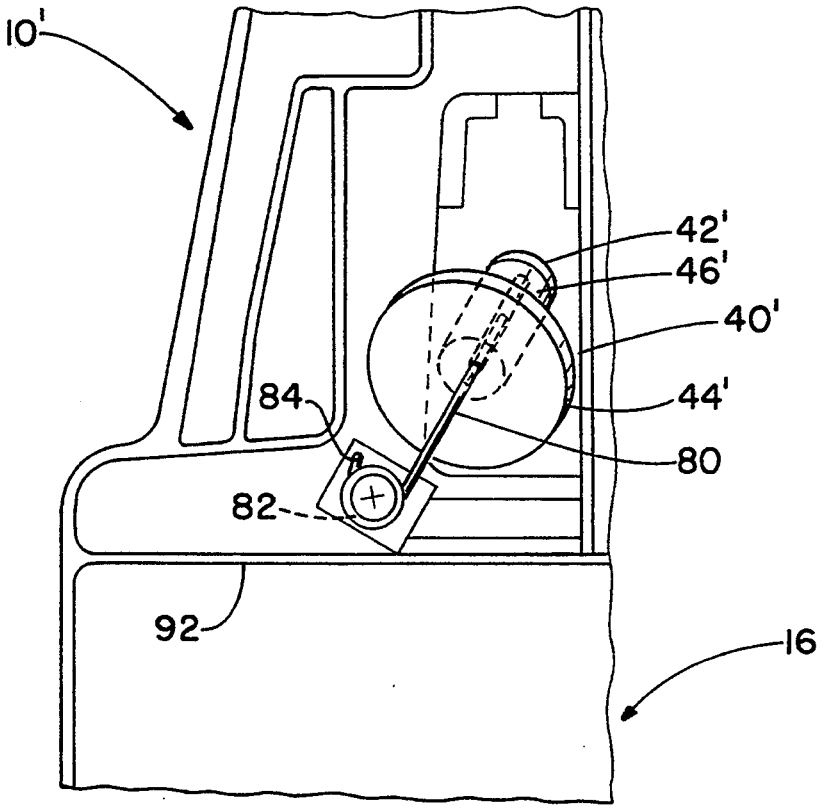
FIG. 6 is a bottom half plan view of this same cleaner.
Figure 5:
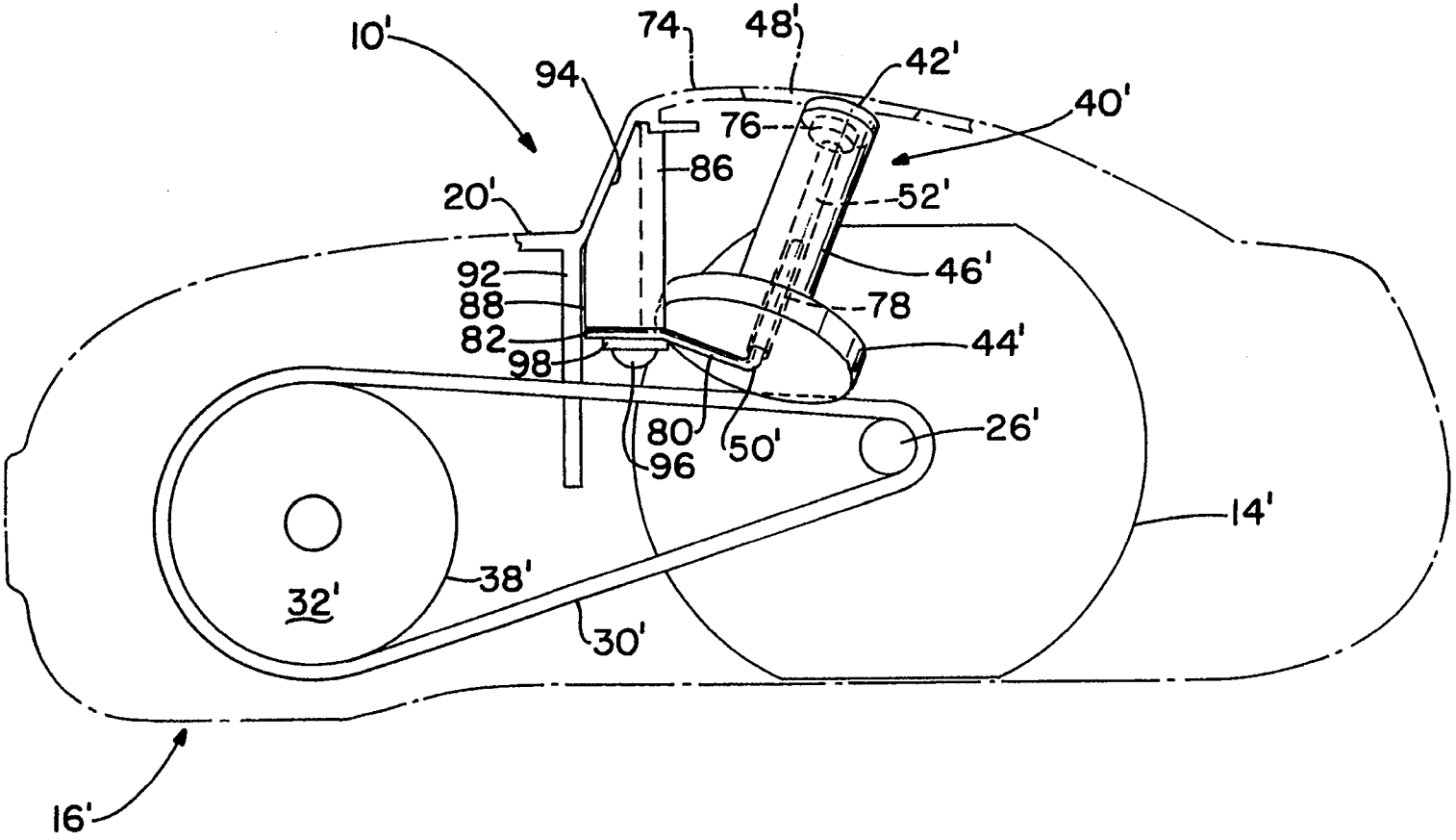
FIG. 5 is a somewhat fragmentary cross-sectional view of a power nozzle incorporating the second embodiment of the inventive belt indicator.

The indicator 50', as seen in FIGS. 5 and 6, is upwardly angled rearwardly and also upwardly inwardly towards the center of the nozzle 20'. The rearward angular inclination is, again, to provide more easy slippage between it and the belt 30' and to reduce the velocity vector transmitted by the agitator belt 30'. It also places the indicator 40' at a convenient angle for viewing through the window 48'. The upwardly inward inclination of indicator 40' is to accommodate nozzle 16 space limitations and, also, to place the indicator disk 42' at the relatively inward location of the window 48'. In this embodiment the rearward angle was chosen as 67° beyond the vertical while the inward angle was set at 30° beyond the vertical.

Turning now to FIGS. 7 and 8, it can be seen that a rotatably driven indicator 40" has been provided to detect agitator brush wear. This indicator is mounted offset relative to the brushes through a hood 20" by means of a through aperture 100 in the hood 20" and includes an indicator disk 42" and a drive wheel disk 44" spacedly separated by a spacing shaft 46". The drive wheel disk 44" is disposed to be engaged by a row of spiralling brush tufts 102 on a rotating agitator 104 disposed, conventionally, within the hood 20". As is seen, an angular disposition of the drive wheel disk 44" provides for more slippage and only a partial vector transfer of the peripheral velocity of the agitator 104 to the indicator 40".

A hollow hat shaped slanted cylindrical spacer 106 is mounted by gluing or the like on the top side of the hood 20" within a bore 108 of which is rotatably journalled the spacing shaft 46" of indicator 40". The spacing shelf 46" is of longer length than the bore 108 so that the indicator 40" is capable of movement vertically upwardly and downwardly within the bore 108 as dictated by the locus of the abutment of the bottom surface of the drive wheel disk 44" with the brush tufts 102.

The angular disposition of the indicator 40" is due to the angularity of bore 108 as it passes through upper cylindric part 110 of hat shaped cylindrical spacer 106 since it is also angled relative to its bottom rim 112 and the top surface of hood 20". The spacing shaft 46" is thereby disposed angularly so that the total disposition of the indicator 40" is angular relative to the hood 20" and the agitator 104. It should be clear that the angle of inclination of the indicator 40" may be either toward or away from a center line of the cleaner of which the hood 20" is a part, with this center line running from the front to the back of the cleaner. This angle may be set based on the relative desired rotational speed of the indicator disk 42" relative to the speed of the agitator.

In order to insure driving rotation of the drive wheel disk 44" by the spiralling brush tufts 102, the bottom side of this wheel includes a series of serration grooves 114, 114 (only two shown) spaced around it. These grooves extend radially inwardly towards the center of the wheel where they are sharply interrupted by a cup shaped depression 116 than limits their demarcation line. A series of twelve of these serrations may be equally spaced around drive wheel disk 42".

FIG. 9 discloses the top surface of an indicator disk 42''' which is marked in a way that may be utilized with any of the embodiments of the instant invention. It includes a white, diametrically extending stripe 118 which may be hot stamped or the like on a black or dark area 120 of the disk. To provide this background, a black plastic may, ideally, be used to mold this disk or the entire indicator if it is an integral single piece including the disk.

The operation of the invention should now be clear. Each of the indicators is pilotingly rotated angularly relative to their driving moving member, restingly lightly on this member as urged only by gravitational forces. This reduces their rotational speed and the friction forces imposed on their bearings, permitting the use of a simple inexpensive bearing arrangement. In all three embodiments, the rotational speed of the indicator blurs the white strip on its dark background so that the disk appears white or gray. When the agitator belt of the first two embodiments stalls or breaks or when the brushes on the agitator of the third embodiment wear sufficiently, the indicator stops or slows sufficiently so that the white stripe is again visible as a stripe on the indicator disk.

It should be clear from the foregoing that all the advantages of the invention set out at the beginning of its description have been satisfied. It should also be clear that many modifications could be made to it which would still fall within its spirit and purview.

What is claimed:

1. A vacuum cleaner having an indicator for signalling a particular operating condition of said vacuum cleaner including:

a) a moving belt member mounted on said vacuum cleaner and rotatably driven by a motor of said vacuum cleaner to have a rotating operating characteristic;

b) an indicator separately mounted from said moving belt member and directly contacting said moving belt member;

c) said indicator including indicia indicating rotation or non-rotation of said indicator;

d) whereby an operator of said vacuum cleaner is provided with a signal of said operating characteristic of said moving belt member;

e) said separate mounting of said indicator being provided by a bearing means rotably receiving and supporting said indicator;

f) said bearing means being spatially displaced from said moving belt member;

g) said indicator extending from said bearing member to abuttingly engage said moving belt member to be moving rotatably driven thereby.

2. The vacuum cleaner and indicator of claim 1 wherein:

a) said indicator member is disposed to engage said moving member angularly.

3. The vacuum cleaner and indicator of claim 2 wherein:

a) said indicator that angularly engages said moving member is inclined upwardly forwardly with respect to a nozzle for said vacuum cleaner.

4. A vacuum cleaner having an indicator for signalling a particular operating condition of said vacuum cleaner including:

a) a moving belt member mounted on said vacuum cleaner and rotatably driven by a motor of said vacuum cleaner to have a rotating operating characteristic;

b) an indicator directly engageably contacting said moving belt member;

c) said indicator including indicia indicating rotation or non-rotation of said indicator member;

d) whereby an operator of said vacuum cleaner is provided with a signal of said operating characteristic of said moving member;

e) said indicator member being disposed to engage said moving belt member angularly;

f) a nozzle for said vacuum cleaner g) said indicator that angularly engages said moving belt member is inclined upwardly rearwardly with respect to said nozzle for said vacuum cleaner;

h) said indicator being separately rotatably mounted from said moving belt member on a bearing means;

i) said bearing means spatially displaced from said moving member; and j) said indicator extending from said bearing means for said engagement with said moving belt member to be rotatably driven thereby.

5. A vacuum cleaner having an indicator for signalling a particular operating condition of said vacuum cleaner including:

a) a moving member mounted on said vacuum cleaner and rotatably driven by a motor of said vacuum cleaner to have a rotating operating characteristic;

b) an indicator directly contacting said moving member to be rotatably driven thereby;

c) said indicator including indicia indicating rotation or non-rotation of said indicator;

d) whereby an operator of said vacuum cleaner is provided with a signal of said operating characteristic of said moving member;

e) said indicator member being disposed to engage said moving member angularly;

f) said indicator being disposed in an offset manner relative to said moving member to thereby receive an unbalanced driving torque from said moving member; and g) said indicator includes a rotatable disk having said indicia marked thereon.

6. The vacuum cleaner and indicator of claim 5 wherein:

a) said indicator is urged only by gravitational force to engage said movable member.

7. The vacuum cleaner and indicator of claim 6 wherein said indicator includes:

a) a driving wheel disk; and b) a spacing shaft disposed between said driving wheel disk and said indicator disk.

8. The vacuum cleaner and indicator of claim 7 wherein:

a) said indicator is formed of plastic;

b) said indicator is mounted rotationally on a means for providing a piloting bearing for said indicator; and c) said means for providing a piloting bearing fixedly mounted with a nozzle for said vacuum cleaner.

9. The vacuum cleaner and indicator of claim 8 wherein:

a) said moving member is a belt driven by said motor.

10. The vacuum cleaner of claim 9 wherein:

a) said belt, upon stall or broken belt condition, no longer drives said indicator rotationally.

11. The vacuum cleaner and indicator of claim 8 wherein:

a) said means for providing a pilotingly bearing for said indicator is formed by a steel shaft.

12. The vacuum cleaner and indicator of claim 11 wherein:

a) said steel shaft is inclined relative to said moving member to provide said angular engagement of said indicator with said movable member.

13. The vacuum cleaner and indicator of claim 12 wherein:

a) said fixed mounting of said piloting bearing is provided by said steel shaft being fixedly embedded in a rib wall of said nozzle.

14. The vacuum cleaner and indicator of claim 12 wherein:

a) said fixed mounting of said piloting bearing is provided by said steel shaft being fixedly embedded in a mounting block of said nozzle.

15. The vacuum cleaner and indicator of claim 14 wherein:

a) said steel shaft is bent to extend at least partially horizontally for said fixed block embeddment so said indicator may be offset from said mounting block.

16. The vacuum cleaner and indicator of claim 4 wherein:

a) said indicator is also inclined upwardly inwardly with respect to said nozzle.

17. The vacuum cleaner and indicator of claim 5 wherein:

a) said movable member comprises an agitator having brushes mounted thereon.

18. The vacuum cleaner and indicator of claim 5 wherein:

a) a means for providing a piloting bearing for said indicator is formed by a hollow plastic bushing.

19. The vacuum cleaner and indicator of claim 18 wherein:

a) said cleaner includes a nozzle;

(b) said hollow plastic bushing is mounted on a top side of said nozzle; and (c) said indicator extends through said nozzle to be rotationally mounted in said bushing.

20. The vacuum cleaner and indicator of claim 17 wherein:

a) said indicator contacts said brushes to be rotationally driven thereby;

b) said brushes wearing away during use to eventually be in a substantially non-engaging position with said indicator;

c) whereby said indicator is no longer rotationally driven by said brushes.

* * * * *